United States Patent [19]

Kardos et al.

[11] 4,009,087

[45] Feb. 22, 1977

[54] ELECTRODEPOSITION OF COPPER

[75] Inventors: Otto Kardos, Ferndale; Donald A. Arcilesi, Mount Clemens; Silvester P. Valayil, Pontiac, all of Mich.

[73] Assignee: M&T Chemicals Inc., Greenwich, Conn.

[22] Filed: Dec. 24, 1975

[21] Appl. No.: 644,350

Related U.S. Application Data

[63] Continuation-in-part of Ser. No. 525,718, Nov. 21, 1974, Pat. No. 3,956,079, and a continuation-in-part of Ser. No. 525,940, Nov. 21, 1974, Pat. No. 3,940,320, which is a continuation-in-part of Ser. No. 315,112, Dec. 14, 1972, abandoned.

[52] U.S. Cl. ..... 204/52 R

[51] Int. Cl.[2] ..... C25D 3/38

[58] Field of Search ..... 204/52 R, 44; 106/1

[56] References Cited

UNITED STATES PATENTS

| | | | |
|---|---|---|---|
| 2,742,413 | 4/1956 | Cransberg et al. | 204/52 R |
| 3,328,273 | 6/1967 | Creutz et al. | 204/52 R |
| 3,373,095 | 3/1968 | Abbott | 204/52 R |

*Primary Examiner*—G. L. Kaplan

*Attorney, Agent, or Firm*—Kenneth G. Wheeless; Robert P. Auber; Robert Spector

[57] ABSTRACT

This invention relates to a process and to novel compositions for electrodepositing copper from an aqueous acidic copper plating bath containing at least one member from each of the following two groups:

A. an N-heteroaromatic compound containing 1 or 2 N-heteroaromatic rings, said rings being selected from a group comprising pyridine, quinoline, isoquinoline and the benzoquinolines, which compound does not contain non-quaternary amino groups that are not part of the said N-heteroaromatic rings, nor bivalent sulfur atoms, and is not quaternized on its ring nitrogen atoms by aralkyl, aryl, alkaryl radicals; and B. sulfoalkylsulfide and sulfoarylsulfide compounds containing the grouping $—S_n—X—SO_3M$ where $n = 1$ to 5, —X— is a divalent aliphatic hydrocarbon group of 1 to 8 carbon atoms or a divalent aromatic or aliphatic-aromatic hydrocarbon group of 6 to 12 carbon atoms and M is one gram-equivalent of a cation.

84 Claims, No Drawings

ELECTRODEPOSITION OF COPPER

This application is a continuation in part of co-pending U.S. patent application Ser. No. 525,718, filed Nov. 21, 1974, now U.S. Pat. No. 3,956,079, and co-pending U.S. patent application Ser. No. 525,940, filed Nov. 21, 1974, now U.S. Pat. No. 3,940,320, which in turn are continuations in part applications of the parent application U.S. patent application Ser. No. 315,112, filed Dec. 14, 1972, now abandoned.

This invention relates to a process and to novel compositions for electrodepositing copper from an aqueous acidic copper plating bath containing at least one member from each of the following two groups:

A. an N-heteroaromatic compound containing 1 or 2 N-heteroaromatic rings, said rings being selected from a group comprising pyridine, quinoline, isoquinoline and the benzoquinolines, which compound does not contain non-quaternary amino groups that are not part of the said N-heteroaromatic rings, nor bivalent sulfur atoms, and is not quaternized on its ring nitrogen atoms by aralkyl, aryl, alkaryl, radicals; and B. sulfoalkylsulfide and sulfoarylsulfide compounds containing the grouping $—S_n—X—SO_3M$ were $n = 1$ to 5, —X— is a divalent aliphatic hydrocarbon group of 1 to 8 carbon atoms or a divalent aromatic or aliphatic-aromatic hydrocarbon group of 6 to 12 carbon atoms and M is one gram-equivalent of a cation.

It is an object of this invention to obtain smooth, ductile, uniform lustrous to semi-bright or fully bright copper deposits for electroforming or rotogravure applications. It is another object to obtain such copper deposits of high throwing power for the plating of printed circuit boards. A further object is to obtain strongly leveled, semi-bright to fully bright copper deposits which require the presence of a leveling agent belonging to Group (C) in addition to the presence of at least one member of each of the two groups (A) and (B).

The simultaneous presence and the cooperative or synergistic action of at least one member of each Group (A) and (B) in the acid copper bath produces superior copper electrodeposits to those obtained when only members of one group are present in respect to one or more of the following properties: greater smoothness, greater uniformity with change of current density, greater brightness, wider bright current density range, greater ductility or more permanent hardness, better response to the addition of leveling agents (Group C).

Pyridine, quinoline, isoquinoline and benzoquinoline compounds show useful cooperation with sulfoalkylsulfides and sulfoarylsulfides even if they are not quaternized on their ring nitrogen atoms by aryl or aralkyl groups.

Even the simplest compound of this group, namely unsubstituted pyridine (Heteroamine No. 1, Example 1) showed at the relatively high concentrations of 10 to 20 g/l cooperation with sulfoalkylsulfides which was enhanced by the presence of the sodium salt of methylenebis(2-naphthalene sulfonic acid).

Substitution of one or more carbon atoms of pyridine by substituents such as alkyl, hydroxyalkyl, sulfoalkyl, sulfoaralkyl, halogen, aroyl, styryl groups enhances the effectiveness of pyridine as an addition agent in varying degrees depending on type and number of substituents. (See Heteroamines No. 2 to 17 and Examples 2 to 12).

Also the linking of two pyridine rings either directly (Heteroamines No. 18, 19, 24) or with the help of bivalent radicals (No. 20, 21, 22, 23, 26) or both (No. 25), enhances the effectiveness of the pyridine compound as an addition agent to acid copper baths (Examples 13 to 15).

Quinoline (No. 27) and isoquinoline (No. 37), each containing two condensed rings, are effective in considerably lower concentrations than pyridine (Examples 16 and 18 versus Example 1). Substitution by alkyl, halogen, haloalkyl, hydroxyl - the latter especially in the 8-position of quinoline - groups produces enhancing or otherwise favorable effects (Heteroamines No. 28 to 36) and linkage of two isoquinoline groups by a diquaternizing divalent aliphatic radical (Heteroamine No. 38) has an especially strong enhancing effect. (See Examples 16 to 19).

5,6-benzoquinoline, 7,8-benzoquinoline, and acridine (2,3-benzoquinoline) all containing three condensed rings, show effective cooperation with sulfoalkyl (or aryl) sulfides at as low concentration as 0.05 g/l even without further substitution or quaternization (Heteroamines No. 39 to 41, Examples 20 and 21).

The N-aryl, N-alkaryl, and especially N-aralkyl quaternary pyridinium, quinolinium and isoquinolinium compounds were the subject of the above mentioned U.S. patent application Ser. Nos. 525,718 and 525,940 and are consequently omitted from this application. The latter covers, besides, non-quaternized pyridine, quinoline, isoquinoline, benzoquinoline compounds (which only in acid solutions or in solid salts would be quaternized by hydrogen ions) also those derivatives in which the ring nitrogen atoms are quaternized by non-aryl, non-alkaryl, and non-aralkyl groups such as alkyl, alkenyl, alkynyl, hydroxyalkyl, sulfoalkyl, carboxyalkyl groups (e.g. No. 12, 15, 19, 21, 34, 35) or by bivalent aliphatic radicals linking two heterocyclic rings together (e.g. No. 25, 38). Also, the N-oxides of pyridine, quinoline, isoquinoline, the benzoquinolines, and their derivatives are cooperating Heteroamines (e.g. No. 22) of this invention.

Besides the N-aryl, N-alkaryl, and N-aralkyl quaternary derivatives this application excludes from group (A) also N-heteroaromatic ring compounds containing one or more bivalent sulfur atoms and/or non-quaternary amino groups which are not part of the pyridine, quinoline, isoquinoline, benzoquinoline rings.

Pyridine and quinoline derivatives carrying -SH,

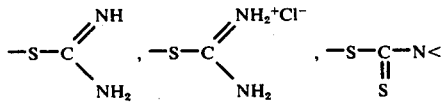

substituents were disclosed in U.S. Pat. No. 3,804,729 which issued Apr. 16, 1974, upon the application of O. Kardos et al. as leveling agents in cooperation with polyethers and organic polysulfides carrying sulfonic groups.

Open thioureas containing pyridine radicals (or vice-versa pyridine derivatives carrying

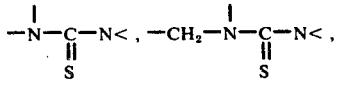

-continued

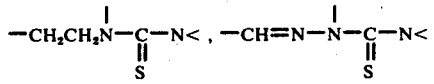

substituents or their mercapto tautomers) were disclosed in U.S. Pat. No. 3,682,788 which issued Aug. 8, 1872, upon the application of O. Kardos et al., as leveling agents in cooperation with polyethers and organic polysulfides carrying sulfonic groups.

Such pyridine and quinoline derivatives containing bivalent sulfur may also act as leveling agents in cooperation with the combination of Group (A) and Group (B) compounds of this invention (see Example 7).

Also some cooperating Group (B) compounds of this invention, e.g. No. 22, contain both a N-heteroaromatic ring and a bivalent sulfur atom and are consequently excluded from the Group (A) compounds of this invention.

The cooperation of certain N-heteroaromatic ring compounds carrying a non-quaternary amino group which is not part of the heteroaromatic ring such as the aminopyridines, aminoquinolines, pyridine-2-aminoethane sulfonic acid etc. with certain sulfoalkylsulfides was the subject of U.S. Pat. Nos. 2,986,498 and 3,030,283 which issued to W. Strauss et al. on May 30, 1961 and Apr. 17, 1962 respectively.

Also the various basic dyestuffs, which in the disclosure of U.S. Pat. No. 3,081,240, issued Mar. 12, 1963 to W. Strauss et al. are described as cooperating with certain sulfoalkylsulfides, contain amino and mono- or dialkyl amino substituents as auxochromes.

Such amino substituted Heteroamines are consequently excluded from the Group (A) compounds of this application.

Besides members of the two groups (A) and (B) or of the three groups (A), (B) and (C), other addition agents may be present and impart a cooperative (synergistic effect, especially aldehyde-naphthalene sulfonic acid condensation products and polyethers.

In many cases, especially when strongly leveling fully bright copper deposits are to be obtained, the presence of small amounts of halide ions, especially chloride ions, in the copper bath is necessary.

The Heteroamines of this invention may be present in the copper bath of this invention in effective amounts of 0.005 g/l to 40 g/l of total aqueous bath composition. The optimum concentration depends on the Heteroamine and the Sulfoalkyl (or aryl) sulfide chosen, the presence or absence of aldehyde-naphthalene sulfonic acid condensats and/or of polyethers and on the desired results.

Typical Heteroamines which may be be employed according to this invention include the following compounds which are summarized in Table I.

TABLE I

| Cooperating Heteroamines (excluding N-aralkyl quaternaries) | |
|---|---|
| 1. 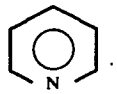 | pyridine |
| 2. 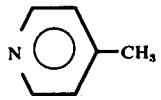 | 4-methylpyridine(4-picoline) |
| 3. 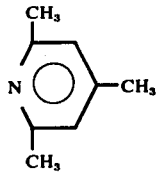 | 2,4,6-collidine |
| 4. 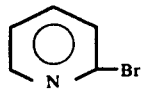 | 2-bromopyridine |
| 5. 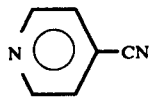 | 4-cyanopyridine |
| 6. 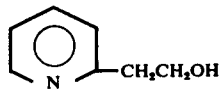 | 2-ethanolpyridine, or 2-(2'-hydroxyethyl)pyridine |
| 7. 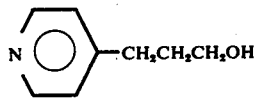 | 4-propanolpyridine, or 4-(3'-hydroxypropyl)pyridine |

TABLE I-continued

| | | |
|---|---|---|
| 8. | 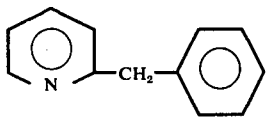 | 2-benzylpyridine |
| 9. | 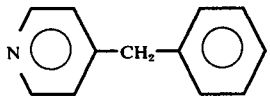 | 4-benzylpyridine |
| 10. | 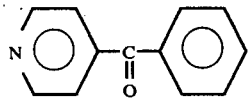 | 4-benzoylpyridine |
| 11. | 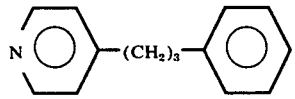 | 4-phenylpropylpyridine, or 4-(3'-phenylpropyl)pyridine |
| 12. | 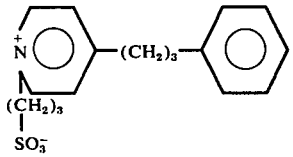 | 1-sulfopropyl-4-phenylpropyl pyridinium betaine |
| 13. | 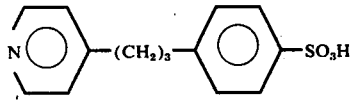 | 4'-sulfo-4-phenyl propylpyridine |
| 14. | 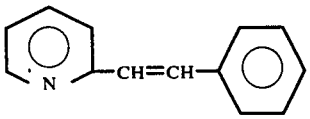 | 2-benzalpicoline (2-styrylpyridine, 2-stilbazole |
| 15. | 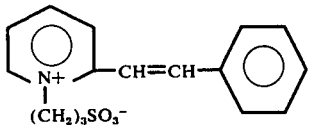 | 1-sulfopropyl-2-styryl pyridinium betaine |
| 16. | 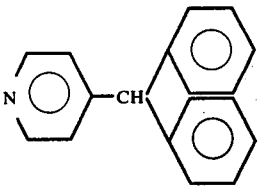 | diphenyl-4-pyridyl methane |
| 17. | 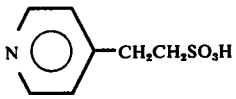 | 4-pyridylethylsulfonic acid |
| 18. | 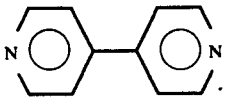 | 4,4-dipyridyl |
| 19. | 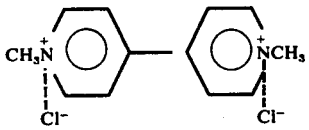 | 1,1'-dimethyl-4,4' dipyridynium dichloride |

TABLE I-continued
| | | |
|---|---|---|
| 20. | 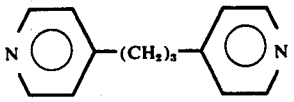 | 1,3-di-(4,4'pyridyl)-propane |
| 21. | 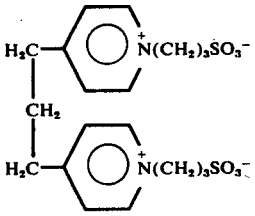 | 1,3-di-(4,4'pyridyl-N,N'dipropanesulfonic acid betaine)-propane |
| 22. | 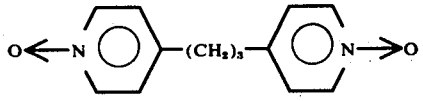 | 1,3-di-(4,4'pyridyl) propane N,N' dioxide |
| 23. | 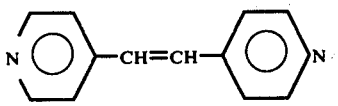 | 1,2-di(4,4'pyridyl)-ethylene |
| 24. | 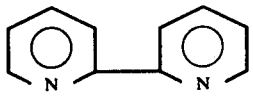 | 2,2-dipyridyl |
| 25. | 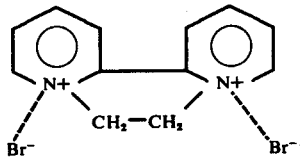 | 1,1'-ethylene-2,2'-dipyridinium dibromide |
| 26. | 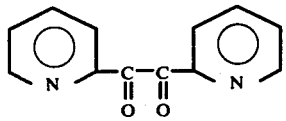 | 2,2'-pyridil 1,2-di-(2'pyridyl) glyoxal |
| 27. | 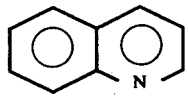 | quinoline |
| 28. | 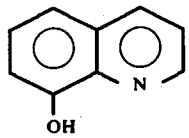 | 8-hydroxyquinoline (8-quinolinol) |
| 29. | 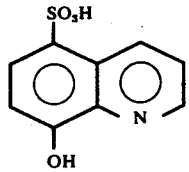 | 8-hydroxyquinoline-5-sulfonic acid |
| 30. | 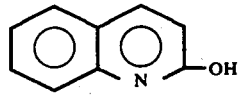 | 2-hydroxy quinoline (2-quinolinol) |
| 31. | 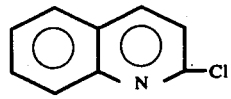 | 2-chloroquinoline |

TABLE I-continued

| | | |
|---|---|---|
| 32. | 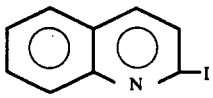 | 2-iodoquinoline |
| 33. | 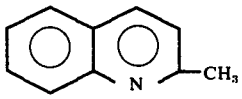 | quinaldine |
| 34. | 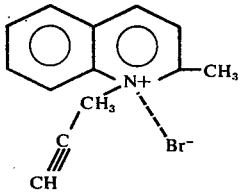 | N-propargylquinaldinium bromide |
| 35. | 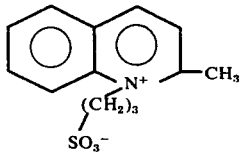 | N-sulfopropylquinaldinium betaine |
| 36. | 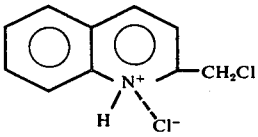 | 2-chloromethylquinoline hydrochloride |
| 37. | 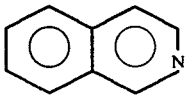 | isoquinoline |
| 38. | 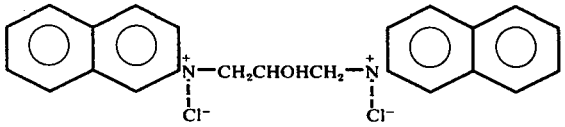 | |
| 39. | 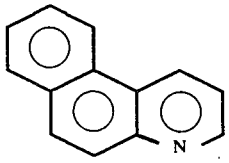 | 5,6-benzoquinoline |
| 40. | 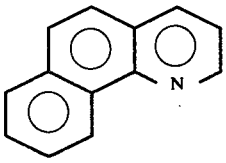 | 7,8-benzoquinoline |
| 41. | 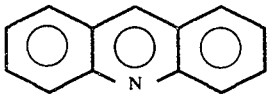 | acridine (2,3-benzoquinoline) |

The cooperating sulfoalkylsulfides and sulfoarylsulfides exhibit the formula:

$$RS_n—X—SO_3M$$

where $n = 1$ to 5, where M denotes a gram equivalent of a cation and —X—is a divalent hydrocarbon group. This divalent hydrocarbon group may be aliphatic, aromatic, or aliphatic-aromatic. If it is aliphatic, it contains 1–8 carbon atoms, it may be saturated or unsaturated, and may or may not carry inert substituents such as hydroxyl, alkyl, hydroxyalkyl, and alkoxy groups; also the carbon chain may be interrupted by heteroatoms. Typical examples for —X— when it is a divalent aliphatic hydrocarbon group are:

$-(CH_2)_m-$ where m is 1 to 8, $-CH_2\,CHOH\,CH_2-$, $-CH_2\,CH(CH_2OH)-$, $-CH_2CH_2\overset{CH_3}{\overset{|}{C}}H-$, $-\overset{CH_3}{\underset{CH_3}{\overset{|}{\underset{|}{C}}}}-CH_2-\overset{CH_3}{\overset{|}{C}}H-$, $-CH_2\,CH{=}CH\,CH_2-$, $-CH_2\,C{\equiv}C\,CH_2-$, $-CH_2\,CH_2\,O\,CH_2\,CH_2-$.

When X is a divalent aromatic hydrocarbon group it may be a phenylene, naphtylene, diphenylene group and may or may not carry inert substituents such as alkyl, hydroxy, hydroxalkyl, alkoxy, and further sulfonic groups. Typical examples for —X— when it is a divalent aromatic hydrocarbon group are:

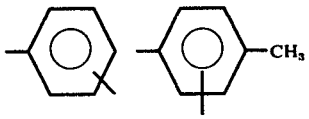

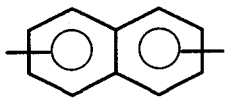

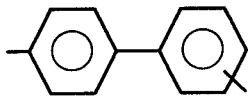

A typical example for —X— when it is an aliphaticaromatic (aralkylene) group is:

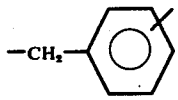

In the compound $R-S_n-X-SO_3M$, R may be a hydrocarbon radical preferably selected from the group consisting of alkyl, alkenyl, alkynyl, cycloalkyl, aryl, aralkyl, alkaryl, including such radicals when inertly substituted such as preferably sulfoalkyl, sulfoaryl, sulfoaralkyl.

R may be hydrogen or a metal cation. It may be a sulfonic group $MO_3S-$ (e.g. in the reaction product of sodium thiosulfate and 1,3-propanesultone), $MO_3S\,Alk$ $S\,\underset{\underset{S}{\|}}{C}-$, $(Alkyl)_2\,N\,\underset{\underset{S}{\|}}{C}-$, $Alkyl\,O\,\underset{\underset{S}{\|}}{C}-$, an aminoiminomethyl (formamidine) group

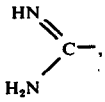

or an other substituted iminomethyl group such as

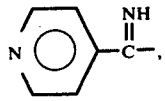

a 1,1-dioxytetrahydrothienyl (sulfolanyl) group

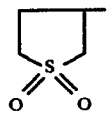

or a heterocyclic ring which may be substituted by other sulfoalkylsulfide groups, etc.

The sulfoalkylsulfides or sulfoarylsulfides may be employed in effective amounts of 0.01 mg/l to 1000 mg/l of total aqueous bath composition. Typical Group (B) compounds which may be employed according to this invention include the following compounds which are summarized in Table II.

TABLE II

COOPERATING SULFOALKYL AND SULFOARYL SULFIDES (SAS) OF THE FORMULA $RS_n-X-SO_3M$

| SAS No. | R | n | X | M |
|---|---|---|---|---|
| | Sulfoalkylsulfides | | | |
| 1 | $NaO_3S(CH_2)_3$ | 2 | $-(CH_2)_3-$ | Na |
| 2 | $NaO_3S(CH_2)_3$ | 3 | $-(CH_2)_3-$ | Na |
| 3 | $NaO_3S(CH_2)_4$ | 2 | $-(CH_2)_4-$ | Na |
| 4 | $NaO_3S(CH_2)_2$ | 2 | $-(CH_2)_2-$ | Na |
| 5 | 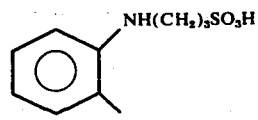 | 2 | $-(CH_2)_3$ | Na |
| 6 | H | 1 | $-(CH_2)_2-$ | Na |
| 7 | H | 1 | $-(CH_2)_3-$ | Na |
| 8 | $NaO_3S$ | 1 | $-(CH_2)_3-$ | Na |
| 9 | $NaO_3S(CH_2)_3S\underset{\underset{S}{\|}}{C}$ | 1 | $-(CH_2)_3-$ | Na |

TABLE II-continued

COOPERATING SULFOALKYL AND SULFOARYL SULFIDES (SAS) OF THE FORMULA $RS_n—X—SO_3M$

| SAS No. | R | n | X | M |
|---|---|---|---|---|
| 10 | $(C_2H_5)_2NC(=S)$ | 1 | $—(CH_2)_3—$ | Na |
| 11 | $C_2H_5OC(=S)$ | 1 | $—(CH_2)_3—$ | K |
| 12 | $NaO_3S(CH_2)_3$ | 1 | $—(CH_2)_3—$ | Na |
| 13 | $NaO_3S(CH_2)_3S(CH_2)_3$ | 1 | $—(CH_2)_3—$ | Na |
| 14 | $NaO_3S(CH_2)_3S(CH_2)_6$ | 1 | $—(CH_2)_3—$ | Na |
| 15 | $C_6H_5$ | 1 | $—(CH_2)_3—$ | Na |
| 16 | $C_6H_5CH_2$ | 1 | $—(CH_2)_3—$ | Na |
| 17 | $HN=C(NH_2)$ | 1 | $—(CH_2)_3—$ | Na |
| 18 | $NaO_3SCH_2CHOHCH_2$ | 2 | $—CH_2CHOHCH_2—$ | Na |
| 19 | 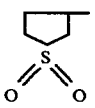 | 1 | $—(CH_2)_3—$ | Na |
| 20 | 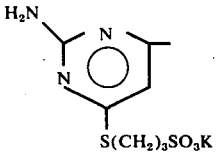 | 1 | $—(CH_2)_3—$ | K |
| 21 | 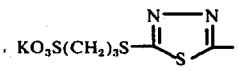 | 1 | $—(CH_2)_3—$ | K |
| 22 | 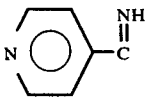 | 1 | $—(CH_2)_3—$ | K |
| | Sulfoarylsulfides | | | |
| 23 | 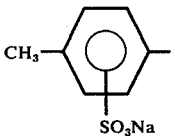 | 2 | 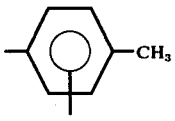 | Na |
| 24 | 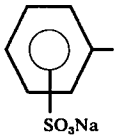 | 2 | 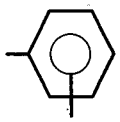 | Na |

Another aspect of this invention is the one of obtaining strongly leveled copper deposits, that is copper deposits which are substantially smoother than the substrate on which they are deposited. In order to possess leveling properties the acid copper plating bath must contain besides at least one member of each of the groups (A) and (B) also at least one member of group (C) comprising the leveling agents, i.e. diffusion controlled inhibitors.

Besides producing leveling the leveling agent frequently also increases brightness, and widens the bright current density range. It may also prevent roughness formation at high current density and increase hardness.

An acid copper bath containing at least one additive from each of the two groups (A) and (B) responds much better to the addition of a leveling agent than a copper bath containing only members of one of the two groups or no members of these two groups.

Leveling agents which cooperate very well with addition agents of groups (A) and (B) are those containing a $$—\underset{\underset{SH}{|}}{C}=N—$$

group or its tautomeric form

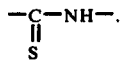

These tautomeric groups may be a part of a noncyclic molecule, such as an open thiourea in which they become a part of the wider groups

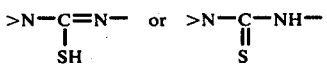

or they may be a part of heterocyclic rings where they may become a part of the wider groups:

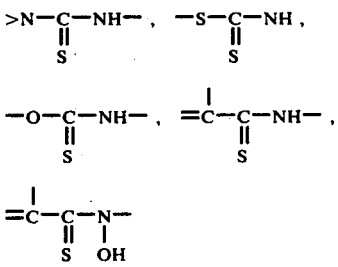

and/or their corresponding tautomeric forms.

Typical leveling agents of the open thiourea type operable in the practice of this invention are set forth in Table III of U.S. Pat. No. 3,682,788 which issued Aug. 8, 1972, upon the application of O. Kardos et al., e.g., thiourea, N-ethylthiourea(1-ethylthiourea), N,N'-diethylthiourea (1,3-diethylthiourea), N-phenylthiourea(1-phenylthiourea), 1-phenyl-3-(3'-pyridyl)thiourea, etc.

Typical leveling agents of the heterocyclic type are set forth in Table III of U.S. Pat. No. 3,542,655 which issued Nov. 24, 1970, upon the application of O. Kardos et al., e.g., 2-thiazolidinethione (2-mercaptothiazoline), 2-imidazolidinethione(ethylenethiourea) and its N-hydroxyethyl derivative, 2-pyrimidinethiol(2-mercaptopyrimidine) and in Table III of U.S. Pat. No. 3,804,729 which issued Apr. 16, 1974, upon the application of O. Kardos et al., e.g. 2-mercaptopyridine, 2-mercaptoquinoline, their N-oxides, and other derivatives in which the —SH group is replaced by

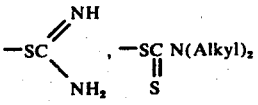

and similar groups, such as e.g. in 2-S-pyridylisothiouronium chloride.

Also levelers which instead of the group

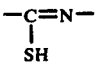

contain the corresponding mercury compound

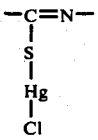

cooperate very well with the Heteroamine plus Sulfoalkylsulfide combination.

The mercapto type levelers may be used over a concentration range of 0.0001 to 0.05 g/l just as in the cases where they are used together with sulfoalkylpolysulfides and sulfoarylpolysulfides but with polyethers instead of the Heteroamines of this application. (Compare e.g. the above mentioned U.S. Pat. No. 3,804,729). The optimum concentration depends on the leveling agent chosen, the cooperating Group (A) and Group (B) compounds, the plating conditions and the desired degree of leveling. Most frequently, it will be between about 0.00025 and 0.005 g/l A different type of cooperating leveling and brightening agent comprises relatively high-molecular organic cations such as basic phenazine azo dyestuffs like Janus Green B (diethylphenosafranine azo dimethylaniline, Color Index No. 11050), Janus Green (also Janus Green G, phenosafranine azo dimethylaniline, Color Index No. 11045) or Janus Black (diethylphenosafranine azo dimethylaniline, Color Index No. 11045) or Janus Black (diethylphenosafranine azo phenol, C. I. Basic Black 2, Color Index No. 11825), certain cationic polymers such as the polyalkyleneimines (molecular weights between about 600 and 60,000) and their derivatives for instance their reaction products with alkylene oxides or 1,3-propane sultone, the polymers and copolymers of 2-vinylpyridine and/or 2-methyl-5-vinylpyridine (molecular weights between about 1000 and 60,000) and their quaternization products with alkyl halides, benzyl halides, or 1,3-propanesultone. The concentration range of these cationic levelers is from about 0.0001 to 0.05 g/l, the optimum concentration decreasing with increasing molecular weight. Simultaneous use of at least one mercapto leveler and at least one cationic leveler together with at least one member of each group (A) and (B), often results in beneficial effects as compared with those obtained with levelers of only one type, in respect to the degree and the current density range of brightness and leveling.

Another type of compounds which often exerts beneficial effects on the copper electrodeposit when used in conjunction with at least one compound of each of the two groups (A) and (B), or of each of the three groups (A), (B) and (C) are the condensation products of an aldehyde, especially formaldehyde, with naphthalene sulfonic acids, such as methylenebis(2-naphthalene sulfonic acid) or higher molecular condensation products of this type in which, for instance, three, or, more generally, $n$, naphthalene sulfonic acid groups are linked by two, or, more generally, $n$-1, methylene groups, where $n$ is 2 to about 7. Addition of such compounds, e.g. of 0.01 to 5.0 g/l of the sodium salt of methylenebis(2-naphthalene sulfonic acid) often increases the brightness and high current density smoothness of copper deposits as compared with deposits obtained from copper baths containing only members of groups (A) and (B), or only members of groups (A), (B) and (C).

These aldehyde-naphthalene sulfonic acid condensates are generally well compatible with the mercapto levelers but much less with the high molecular cationic levelers unless these levelers carry also sulfonic groups.

Still another type of compounds which often exerts beneficial effects when used in conjunction with compounds of the two groups (A) and (B), or with compounds of the three groups (A), (B) and (C) are the polyethers, especially those of rather high molecular weight. As low concentrations as 0.001 g/l to 0.005 g/l of a polyethyleneglycol of a molecular weight of 1000 or 6000 or 20,000, or of a nonylphenol condensate with 100 moles ethylene oxide, or of a block polymer of 80% ethylene oxide and 20% propylene oxide and approximate molecular weight 5000, considerably increase leveling, especially in the low current density area, and often also increases brightness and bright current density range.

On the other hand, addition of a Heteroamine may improve the performance of the polyether-sulfoalkyl (or aryl) sulfide combination in absence or presence of a leveling agent even if the polyether is used at the normal concentration of 0.005 to 10 g/l. (Compare the above cited U.S. Pat. Nos. 3,542,655; 3,682,788 and 3,804,729.) Thus the concentration of the polyether may be between 0.001 and 10 g/l.

The novel compositions of the invention may be employed in combination with aqueous acidic copper plating baths. Typical aqueous acidic copper plating baths which may be employed in combination with the novel additive compositions of this invention include the following:

| | | |
|---|---|---|
| | SULFATE BATH | |
| (1) | $CuSO_4 \cdot 5H_2O$ | 30–300 g/l |
| | $H_2SO_4$ | 10–250 g/l |
| | $Cl^-$ | 0–150 mg/l |
| | FLUOBORATE BATH | |
| (2) | $Cu(BF_4)_2$ | 50–600 g/l |
| | $HBF_4$ | 1–300 g/l |
| | $H_3BO_3$ | 0–30 g/l |
| | $Cl^-$ | 0–150 mg/l |

For the deposition of bright, leveling copper about 200 g/l of $CuSO_4 \cdot 5H_2O$ or $Cu(BF_4)_2$, about 60 g/l of $H_2SO_4$ or 3.5 g/l of a $HBF_4$, and about 20 to 80 mg/l of chlorine ion are preferred. For high-speed plating, e.g., the plating of printing rolls, higher concentrations of the free acids and/or of the copper fluoborate are often preferred. For the plating of printed circuit boards, which requires high throwing power, low metal and high acid concentrations are most suitable.

The plating conditions for electrodeposition from the aforementioned baths may, for example, include temperatures of 10° – 60° C (preferably 20° – 40° C); pH (electrometric) of less than about 2.5; and a cathode current density of 0.1 – 50.0 amperes per square decimeter. The higher temperature range is especially applicable for high speed plating at rather uniform current density and/or when maximum brightness and leveling are not required.

The substrates which may be electroplated in accordance with the process of this invention may include ferrous metals, such as steel, iron, etc., bearing a surface layer of nickel or cyanide copper; zinc and its alloys including zinc-base die-cast articles bearing a surface layer of cyanide copper or pyrophosphate copper; nickel, nickel alloys with other metals such as cobalt or iron; aluminum, including its alloys, after suitable pretreatment; and non-conducting materials, e.g., plastics, after suitable pretreatment, etc.

The following examples are set forth for the purpose of providing those skilled in the art with a better understanding of this invention, and the invention is not to be construed as limited to such examples.

The plating experiments reported in the following examples were performed, unless otherwise stated, in a Hull Cell containing 250 ml of acid copper sulfate bath. The Hull Cell allows one to observe the appearance of the deposit over a wide current density range. In order to judge the degree of leveling the polished brass panels used for these plating tests were scratched with 4/0 emery polishing paper over a horizontal band of about 10 mm width. After the standard cleaning procedures and rinses the brass panels were generally given a short nickel strike from a Watt's nickel bath containing no addition agents, followed by thorough rinsing. The plating temperature used in these experiments was the ambient room temperature (24° – 30° C) unless otherwise stated. The total current was 2 amperes and the plating time 10 minutes. Air agitation was used in all cases. The heteroamines used are listed in Table I, the Sulfoalkylsulfides (or Sulfoarylsulfides) in Table II.

Two types of acid sulfate copper baths were used in these experiments:

| | | |
|---|---|---|
| Type 1.) | Regular Sulfate Copper containing | |
| | $CuSO_4 \cdot 5H_2O$ | 220 g/l |
| | $H_2SO_4$ | 60 g/l |
| | Chloride ion | 0.06 g/l |
| and Type 2.) | High-Throw Sulfate Copper containing | |
| | $CuSO_4 \cdot 5H_2O$ | 100 g/l |
| | $H_2SO_4$ | 200 g/l |
| | Chloride ion | 0.06 g/l |

The chloride concentrations indicated above are those after addition of the various additives as some Heteroamines of Table I contain chloride.

EXAMPLE 1

Addition of 10 g/l Heteroamine No. 1 to an acid copper bath of Type 1 gave a copper deposit which was semibright below about 1.2 amp/sq dm and matte above this current density. Addition of 0.016 g/l of Sulfoalkylsulfide No. 1 produced semibrightness above about 9 amp/sq dm. Further addition of 0.4 g/l of the sodium salt of methylenebis(2-naphthalene sulfonic acid) produced a semibright deposit over most of the Hull Cell panel and final addition of 0.0015 g/l of 2-mercaptothiazoline strongly increased leveling. A leveling bright deposit was obtained when both the concentrations of Heteroamine No. 1 and of the Sulfoalkylsulfide No. 1 were doubled to 20 g/l and 0.032 g/l, respectively.

EXAMPLE 2

In a Type 1 acid copper bath 4 g/l of Heteroamine No. 2 gave a copper deposit which was semibright below about 1.2 amp/sq dm and matte above this current density. Addition of 0.015 g/l of Sulfoalkylsulfide No. 1 produced a mattish semibright deposit between about 2.5 and 10 amp/sq dm and a bright deposit above 10 amp/sq dm. Further addition of 0.001 g/l of 2-mercaptothiazoline (2-thiazolidinethione) and 0.001 g/l of 1-(2-hydroxyethyl) ethylenethiourea produced a hazy bright to bright copper deposit with some leveling.

Final addition of 1 g/l of the sodium salt of methylenebis(2-naphthalene sulfonic acid) increased the rate of leveling and the degree, uniformity and current density range of brightness.

EXAMPLE 3

The matte deposit obtained in a Type 1 acid copper bath in presence of 5 g/l of Heteroamine No. 3 became after addition of 0.015 g/l Sulfoalkylsulfide mattish-semibright below about 8 amp/sq dm and bright above this current density. Final addition of either 0.015 g/l of Janus Green, or of 0.001 g/l of 2-mercatothiazoline and 0.001 g/l of 1-(2-hydroxyethyl) ethylenethiourea, produced bright copper deposits over almost the whole Hull Cell current density range with good leveling characteristics. The latter were further enhanced by addition of 0.0025 g/l of Pluronic 10R8, a block polymer having a polyoxyethylene group of approximate molecular weight 4000 in the center and two polyoxypropylene groups, each of approximate molecular weight 500, on either end, and thus of the approximate formula: $HO(C_3H_6O)_{8.5}(C_2H_4O)_{90}(C_3H_6O)_{8.5}H$.

EXAMPLE 4

In a copper bath of Type 1, 2.64 g/l of Heteroamine No. 4 showed only slight brightening cooperation with 0.016 g/l of Sulfoalkylsulfide No. 1. Cooperation became very good when furthermore 0.1 g/l of the sodium salt of methylenebis(2-naphthalene sulfonic acid) was added, resulting in a copper deposit which was bright above 0/9 amp/sq dm and semibright below this current density. Final addition of 0.0015 g/l of 2-mercaptothiazoline produced a bright deposit over almost the whole current density range which possessed strong leveling properties.

The combination of 2.5 g/l of Heteroamine No. 4 and 0.1 g/l of the sodium salt of methylenebis(2-naphthalene sulfonic acid) in absence of Sulfoalkylsulfides and levelers, produced a deposit which was matte above about 1.4 amp/sq dm and semibright below this current density. Further addition of 0.028 g/l of Sulfoalkylsulfide No. 4 or of 0.02 to 0.04 g/l of Sulfoalkylsulfide No. 7 or of 0.02 g/l of Sulfoalkylsulfide No. 10 or No. 12 or No. 16 increased brightness, with good response to the final addition of 0.0015 g/l of 2-mercaptothiazoline in the cases of Sulfoalkylsulfides No. 4 and No. 7.

EXAMPLE 5

0.2 g/l of Heteroamine No. 10 gave in a Type 1 bath a matte deposit and response to the addition of 0.016 g/l of Sulfoalkylsulfide No. 1 and then of 0.0015 g/l of 2-mercaptothiazoline was very small. However, final addition of 0.4 g/l of the sodium salt of methylenebis(2-naphthalene sulfonic acid) produced a semibright copper deposit over most of the Hull Cell panel, which possessed strong leveling properties.

EXAMPLE 6

In a copper bath of Type 1, 0.4 g/l of Heteroamine No. 11 gave a Hull Cell panel which was matte over most of the current density range and strongly striated from about 5 to 11 amp/sq dm.

Addition of 0.015 g/l of Sulfoalkysulfide No. 1 produced a smooth bright deposit above about 1 amp/sq dm. Final addition of a mixture of 0.001 g/l of 2-mercaptothiazoline and 0.001 g/l of 1-(2-hydroxyethyl) ethylenethiourea produced a bright deposit over the whole current density range with strong leveling properties.

Also, the combination of 0.4 g/l of Heteroamine No. 11, 0.032 g/l of Sulfoalkylsulfide No. 1 and 0.022 g/l of a reaction product of poly(2-vinylpyridine) of approximate MW 40,000 with propane sultone (about 1 mole 1,3-propane sultone per pyridine group) produced a bright strongly leveling copper deposit over almost the whole Hull Cell current density range.

EXAMPLE 7

1 g/l of Heteroamine No. 12 produced a smooth, uniform, very light matte deposit over the whole current density range in a Type 1 bath. Further addition of 0.004 g/l of Sulfoalkylsulfide No. 1 produced a bright copper deposit from 0.6 amp/sq dm upwards.

The combinations of 1 g/l of Heteroamine No. 12, 0.016a g/l of Sulfoalkylsulfide No. 1 and of 0.016 g/l of Janus Green or 0.003 g/l of 2-S-pyridylisothiouronium chloride,

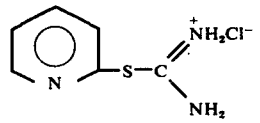

produced bright copper deposits over the whole Hull Cell panel which possessed considerable leveling properties, especially with the second leveling agent.

The addition of 0.016 g/l of Sulfoalkylsulfide No. 10 to a copper bath of Type 1 containing 1 g/l of Heteroamine No. 10 produced a deposit which was semibright up to about 10 amp/sq dm and bright above this current density, while the addition of 0.004 g/l of Sulfoalkylsulfide No. 12 produced a uniformly semibright deposit over the whole current density range of the Hull Cell panel.

EXAMPLE 8

In a Type 2 (High-throw) acid copper bath 2 g/l of Heteroamine No. 13 gave a matte deposit over most of the current density range with roughness and powder formation above about 8 amp/sq dm and very good back-coverage of the Hull Cell panel. Further addition of 0.004 g/l of Sulfoalkylsulfide No. 1 produced a uniform hazy-bright deposit up to about 10 amp/sq dm and a bright deposit between about 10 and 12 amp/sq dm with only slight roughness at the high current density edge and still very good back-coverage.

EXAMPLE 9

In an acid copper bath of Type 1 as little as 0.05 g/l of Heteroamine No. 14 produced a strongly striated copper deposit over most of the Hull Cell current density range and a smooth bright deposit only below about 0.3 amp/sq dm. Further addition of 0.016 g/l of Sulfoalkylsulfide No. 1 produced a bright deposit above about 1.6 amp/sq dm which, however, was still striated above about 11 amp/dq dm. Increase of the Sulfoalkylsulfide concentration to 0.032 g/l produced a bright deposit from about 3 amp/sq dm upwards which was smooth up to and including the high current density edge of the Hull Cell panel. Further addition of 0.0015 g/l of 2-mercaptothiazoline produced a moderate increase of leveling and widening of the bright current density range down to about 2 amp/sq dm. Combined used of 0.0015 g/l of 2-mercaptothiazoline with either 0.01 g/l of Janus Green or 0/0025 g/l of polyethylene glycol (MW 6000) strongly increased leveling and widened the bright current density range downwards leaving only slight haziness below about 0.4 amp/sq dm.

EXAMPLE 10

In a Type 1 copper cath 0.1 g/l of Heteroamine No. 15 gave a uniform light-matte deposit, 0.2 g/l of the Heteroamine produced a brighter deposit which was striated above about 11 amp/sq dm and 0.4 g/l gave a very strongly striated semibright (below about 3 amp/sq dm) to matte copper deposit. Further addition of 0.016 g/l of Sulfoalkylsulfide No. 1 eliminated the striations and brightened the high current density range, the width of this bright range extending towards lower current densities with increasing concentration of Heteroamine No. 15.

All three combinations responded with substantial leveling and widened bright current density range to the addition of 0.015 g/l of Janus Green, with some further improvement on addition of also 0.001 g/l of 2-mercaptothiazoline.

EXAMPLE 11

0.1 g/l of Heteroamine No. 16 gave in a Type 1 bath a copper deposit which was dark-matte above 0.4 amp/sq dm and semibright below this current density. Further addition of 0.032 g/l of Sulfoalkylsulfide No. 1 gave a copper deposit which was smooth and bright above about 1 amp/sq dm and semibright below this current density. Final addition of 0.0015 g/l of 2-mercaptothiazoline increased leveling and low current density brightness.

EXAMPLE 12

In a High-Throw (Type 2) bath, 2 g/l of Heteroamine No. 17 gave a dark-matte deposit over most of the Hull Cell panel with some roughness and powderiness in the high current density range. Further addition of 0.0016 g/l Sulfoalkylsulfide No. 1 and 0.64 g/l of the sodium salt of methylenebis(2-naphthalene sulfonic acid) produced a hazy to fully bright deposit up to about 8 amp/sq dm with good coverage of the back of the Hull Cell panel.

EXAMPLE 13

0.5 g/l of Heteroamine No. 18 gave in a Type 1 bath a dark-matte deposit above about 0.8 amp/sq dm and a slightly lustrous deposit below this current density. Further addition of 1 g/l of the sodium salt of methylenebis(2-naphthalene sulfonic acid) produced a lustrous deposit up to about 11 amp/sq dm which became much brighter on final addition of 0.0015 g/l of Sulfoalkylsulfide No. 1.

EXAMPLE 14

0.1 g/l of Heteroamine No. 19 gave in a Type 1 bath a copper deposit which was matte above about 0.8 amp/sq dm and slightly lustrous below this current density. Further addition of 0.016 g/l of Sulfoalkylsulfide No. 1 produced a deposit which was bright above about 1.8 amp/sq dm and semibright below this current density, but response to levelers such as 2-mercaptothiazoline or Janus Green was weak.

EXAMPLE 15

0.1 g/l of Heteroamine No. 20 produced in a Type 1 bath a copper deposit which was matte over almost the whole Hull Cell current density range, except below about 0.8 amp/sq dm where it was slightly lustrous. Addition of 0.016 g/l of Sulfoalkylsulfide No. 1 produced a bright deposit above about 6.5 amp/sq dm with some luster between 2.5 and 6.5 amp/sq dm. Further addition of 0.001 g/l of 2-mercaptothiazoline and 0.001 g/l of 1-(2-hydroxyethyl) ethylenethiourea produced only slight brightening below about 2 amp/sq dm, but final addition of 0.65 g/l of the sodium salt of methylenebis(2-naphthalene sulfonic acid) produced a fully bright copper deposit over the whole current density range with considerable leveling properties.

The combination of 0.2 g/l of Heteroamine No. 20 and 0.1 g/l of the sodium salt of methylenebis(2-naphthalene sulfonic acid) gave in the Type 2 bath a copper deposit which was semibright below about 0.8 amp/sq dm, light-matte between about 0.8 and 4 amp/sq dm, and dark-matte at higher current densities, and showed excellent coverage of the back of the Hull Cell panel. Further addition of Sulfoalkylsulfides or Sulfoarylsulfides had the following beneficial effects:

0.004 g/l of Sulfoalkylsulfide No. 1 gave a copper deposit which was hazy-bright below about 1.7 amp/sq dm and fully bright above this current density. The combination of 0.004 g/l of Sulfoalkylsulfide No. 1 with 0.2 g/l of Heteroamine No. 22 (the double N-oxide of No. 20) gave very similar results;

0.002 g/l of Sulfoalkylsulfide No. 9 gave a hazybright deposit below about 2 amp/sq dm and a fully bright deposit between 2 and 9 amp/sq dm; 0.008 g/l of Sulfoalkylsulfide No. 12 gave a semibright deposit below about 3 amp/sq dm and a fully bright deposit from 3 amp/sq dm upwards; 0.002 g/l of Sulfoalkylsulfide No. 14 produced a deposit which was hazy bright up to about 7 amp/sq dm and dark matte above this current density while increase of the Sulfoalkylsulfide to 0.02 g/l produced a deposit which was bright above about 1.2 amp/sq dm and matte at lower current densities;

0.002 as well as 0.004 g/l of Sulfoalkylsulfide No. 16 produced deposits which were bright above about 2 amp/sq dm and semibright below this current density;

0.008 g/l of Sulfoalkylsulfide No. 17 gave an almost fully bright copper deposit up to more than 11 amp/sq dm;

0.002 g/l of Sulfoalkylsulfide No. 22 gave a bright deposit up to about 9 amp/sq dm.

0.002 g/l of the Sulfoarylsulfide SAS No. 23 gave a bright deposit up to 10 amp/sq dm.

EXAMPLE 16

In a Type 1 acid copper bath 2 g/l of Heteroamine No. 27 gave a copper deposit which was matte above about 1.2 amp/sq dm and almost semibright below this current density, with some high current density roughness. Addition of 0.016 g/l of Sulfoalkylsulfide No. 1 produced a bright smooth copper deposit above 2 amp/sq dm. Subsequent addition of 0.0015 g/l of 2-mercaptothiazoline widened the bright current density range and increased leveling with a further improvement of these properties by addition of 0.0025 g/l of a polyethylene glycol of approximate molecular weight 6000. This combination of four additives gave much stronger leveling and much better low current density brightness than obtained with three of the additives but in absence of Heteroamine No. 27.

In a High-Throw (Type 2) bath, 0.4 g/l of Heteroamine No. 27 gave a matte copper deposit over the whole current density range. Addition of 0.64 g/l of the sodium salt of methylenebis(2-naphthalene sulfonic acid) increased the luster to a mattish semibrightness with considerable roughness above about 3 amp/sq dm. Further addition of 0.0016 g/l of Sulfoalkylsulfide No. 1 produced a bright smooth copper deposit below about 9 amp/sq dm with excellent back coverage. With only 0.1 g/l of Heteroamine No. 27 and the same concentrations of the other two additives as before the deposit was uniformly semibright up to about 9 amp/sq dm.

EXAMPLE 17

0.5 g/l of Heteroamine No. 28 gave in a Type 1 bath a dark matte copper deposit from about 1 amp/sq dm to 11 amp/sq dm, a bright deposit below 0.9 amp/sq dm and a lustrous somewhat rough deposit above 11 amp/sw dm. Addition of 0.016 g/l of Sulfoalkylsulfide No. 1 produced a smooth copper deposit which was bright above 0.9 amp/sq dm and semibright below this current density. Addition of 0.001 g/l of 2-mercaptothiazoline increased leveling to a moderate extent.

In a High-Throw bath 0.5 g/l of Heteroamine No. 28 gave a dark matte deposit above about 1 amp/sq dm with roughness above about 8 amp/sq dm, and a semibright deposit below 1 amp/sq dm with excellent back coverage. Addition of 0.016 g/l of Sulfoalkylsulfide No. 1 produced a hazy-bright deposit up to about 2 amp/sq dm and a fully bright deposit from about 2 to 8.5 amp/sq dm with a dark-matte area at higher current density. Final addition of 0.1 g/l of the sodium salt of methylenebis(2-naphthalene sulfonic acid) produced a fully bright deposit over the whole Hull Cell panel, which was ductile and gave excellent back coverage of the panel. The same combination but with only 0.1 g/l of Heteroamine No. 28, gave a ductile light matte to semibright copper deposit up to about 10 amp/sq dm.

EXAMPLE 18

2 g/l of Heteroamine No. 37 gave in a Type 1 acid copper bath a copper deposit which was darkish matte from about 0.8 to 11 amp/sq dm, semibright below 0.8 amp/sq dm and rough and lustrous above 11 amp/sq dm. Addition of 0.016 g/l of Sulfoalkylsulfide No. 1 produced a smooth bright deposit from 0.6 amp/sq dm upwards and final addition of 0.0015 g/l of 2-mercaptothiazoline increased leveling and brightness.

EXAMPLE 19

In a copper bath of Type 1, 0.09 g/l of Heteroamine No. 38 gave a copper deposit which was semibright below about 1 amp/sq dm matte above about 5 amp/sq dm and striated in between. Addition of 0.048 g/l of Sulfoalkylsulfide No. 1 produced a bright deposit above 1.2 amp/sq dm. Final addition of 0.0015 g/l of 2-mercaptothiazoline increased leveling and also brightness below 1.2 amp/sq dm.

EXAMPLE 20

Addition of 0.05 g/l of Heteroamine No. 39 to a Type 1 copper bath gave a darkish-lustrous copper deposit which was strongly striated above about 1.8 amp/sq dm. Addition of 0.032 g/l of Sulfoalkylsulfide No. 1 gave a smooth electrodeposit, fully bright above about 1.2 amp/sq dm and slightly hazy below this current density. Further addition of 0.0015 g/l of 2-mercaptothiazoline and/or 0.01 g/l of Janus Green increased leveling. Also the combination of only 0.01 g/l of Heteroamine No. 39, 0.032 g/l of Sulfoalkylsulfide No. 1 and 0.015 g/l of Janus Green gave a bright copper deposit over almost the whole Hull Cell panel possessing fair leveling properties.

In a Type 1 copper bath containing 1 g/l of polyethylene glycol of approximate molecular weight 1000 and 0.016 g/l of Sulfoalkylsulfide No. 1, addition of 0.02 to 0.05 g/l of Heteroamine No. 39 increased brightness below about 3 amp/sq dm.

EXAMPLE 21

0.05 g/l of Heteroamine No. 41 gave a copper deposit which was bright below about 0.4 amp/sq dm matte above about 8 amp/sq dm and strongly striated in between. Addition of 0.032 g/l of Sulfoalkylsulfide No. 1 produced a copper deposit which was smooth over the whole current density range, bright above about 2.5 amp/sq dm and semibright below this current density. Further addition of 0.0015 g/l of 2-mercaptothiazoline enhanced brightness and leveling slightly but final addition of 0.01 g/l of Janus Green produced a deposit which was bright over the whole current density range and possessed rather strong leveling power.

We claim:

1. A process for electrodepositing copper from an aqueous acidic copper plating bath containing at least one member independently selected from each of the following two groups:

A. 0.005 to 40 grams per liter of an N-heteroaromatic compound containing 1 or 2 N-heteroaromatic rings, said rings being selected from a group consisting of pyridine, quinoline, isoquinoline and the benzoquinolines, which compound does not contain nonquaternary amino groups that are not part of the said N-heteroaromatic rings, nor bivalent sulfur atoms, and is not quaternized on its ring nitrogen atoms by aralkyl, aryl, alkaryl radicals; and B. about 0.01 mg/l to 1000 m/l of sulfoalkylsulfide and sulfoarylsulfide compounds containing the grouping $—S_n—X—SO_3M$ where $n = 1$ to 5, —X— is a divalent aliphatic hydrocarbon group of 1 to 8 carbon atoms or a divalent aromatic or aliphatic-aromatic hydrocarbon group of 6 to 12 carbon atoms and M is one gram-equivalent of a cation.

2. The process of claim 1 wherein at least one N-heteroaromatic compound is pyridine.

3. The process of claim 1 wherein at least one N-heteroaromatic compound is 4-methylpyridine.

4. The process of claim 1 wherein at least one N-heteroaromatic compound is 2,4,6-collidine.

5. The process of claim 1 wherein at least one N-heteroaromatic compound is 2-bromopyridine.

6. The process of claim 1 wherein at least one N-heteroaromatic compound is 4-cyanopyridine.

7. The process of claim 1 wherein at least one N-heteroaromatic compound is 2-(2′-hydroxyethyl) pyridine.

8. The process of claim 1 wherein at least one N-heteroaromatic compound is 4-(3′-hydroxypropyl) pyridine.

9. The process of claim 1 wherein at least one N-heteroaromatic compound is 2-benzylpyridine.

10. The process of claim 1 wherein at least one N-heteroaromatic compound is 4-benzylpyridine.

11. The process of claim 1 wherein at least one N-heteroaromatic compound is 4-benzoylpyridine.

12. The process of claim 1 wherein at least one N-heteroaromatic compound is 4-(3'-phenylpropyl) pyridine.

13. The process of claim 1 wherein at least one N-heteroaromatic compound is 1-sulfopropyl-4-phenylpropyl pyridinium betaine.

14. The process of claim 1 wherein at least one N-heteroaromatic compound is 4'-sulfo-4-phenyl propylpyridine.

15. The process of claim 1 wherein at least one N-heteroaromatic compound is 2-benzalpicoline (2-styrylpyridine 2-stilbazole).

16. The process of claim 1 wherein at least one N-heteroaromatic compound is 1-sulfopropyl-2-styryl pyridinium betaine.

17. The process of claim 1 wherein at least one N-heteroaromatic compound is diphenyl-4-pyridyl methane.

18. The process of claim 1 wherein at least one N-heteroaromatic compound is 4-pyridylethylsulfonic acid.

19. The process of claim 1 wherein at least one N-heteroaromatic compound is 4,4'-dipyridyl.

20. The process of claim 1 wherein at least one N-heteroaromatic compound is 1,1'-dimethyl-4,4'dipyridynium dichloride.

21. The process of claim 1 wherein at least one N-heteroaromatic compound is 1,3-di-(4,4'pyridyl-N,N'dipropanesulfonic acid betaine)-propane.

22. The process of claim 1 wherein at least one N-heteroaromatic compound is 1,3-di-(4,4'-pyridyl-N,N'dipropanesulfonic acid betaine)-propane.

23. The process of claim 1 wherein at least one N-heteroaromatic compound is 1,3-di-(4,4'pyridyl) propane N,N'dioxide.

24. The process of claim 1 wherein at least one N-heteroaromatic compound is 1,2-di-(4,4'pyridyl)-ethylene.

25. The process of claim 1 wherein at least one N-heteroaromatic compound is 2,2-dipyridyl.

26. The process of claim 1 wherein at least one N-heteroaromatic compound is 1,1-ethylene-2,2'-dipyridinium dibromide.

27. The process of claim 1 wherein at least one N-heteroaromatic compound is 2,2'-pyridil-1,2-di-(2'-pyridyl) glyoxal.

28. The process of claim 1 wherein at least one N-heteroaromatic compound is quinoline.

29. The process of claim 1 wherein at least one N-heteroaromatic compound is 8-hydroxyquinoline(8-quinolinol).

30. The process of claim 1 wherein at least one N-heteroaromatic compound is 8-hydroxyquinoine-5-sulfonic acid.

31. The process of claim 1 wherein at least one N-heteroaromatic compound is 2-hydroxy quinoline(2-quinolinol).

32. The process of claim 1 wherein at least one N-heteroaromatic compound is 2-chloroquinoline.

33. The process of claim 1 wherein at least one N-heteroaromatic compound is 2-iodoquinoline.

34. The process of claim 1 wherein at least one N-heteroaromatic compound is quinaldine.

35. The process of claim 1 wherein at least one N-heteroaromatic compound is N-propargylquinaldinium bromide.

36. The process of claim 1 wherein at least one N-heteroaromatic compound is N-sulfopropylquinaldinium betaine.

37. The process of claim 1 wherein at least one N-heteroaromatic compound is 2-chloromethylquinoline hydrochloride.

38. The process of claim 1 wherein at least one N-heteroaromatic compound is isoquinoline.

39. The process of claim 1 wherein at least one N-heteroaromatic compound is

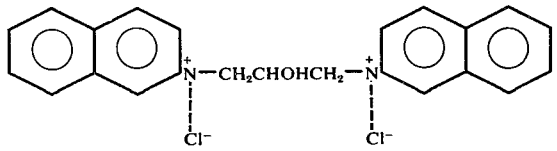

40. The process of claim 1 wherein at least one N-heteroaromatic compound is 5,6-benzoquinoline.

41. The process of claim 1 wherein at least one N-heteroaromatic compound is 7,8-benzoquinoline.

42. The process of claim 1 wherein at least one N-heteroaromatic compound is acridine (2,3-benzoquinoline).

43. An aqueous acidic copper electroplating bath containing at least one member independently selected from each of the following two groups:

A. 0.005 to 40 grams per liter of an N-heteroaromatic compound containing 1 or 2 N-heteroaromatic rings, said rings being selected from a group consisting of pyridine, quinoline, isoquinoline and the benzoquinolines, which compound does not contain nonquaternary amino groups that are not part of the said N-heteroaromatic rings, nor bivalent sulfur atoms, and is not quaternized on its ring nitrogen atoms by aralkyl, aryl, alkaryl radicals; and B. about 0.01 mg/l to 1000 mg/l of sulfoalkylsulfide and sulfoarylsulfide compounds containing the grouping $—S_n—X—SO_3M$ where $n = 1$ to 5, —X— is a divalent aliphatic hydrocarbon group of 1 to 8 carbon atoms or a divalent aromatic or aliphatic-aromatic hydrocarbon group of 6 to 12 carbon atoms and M is one gram-equivalent of a cation.

44. The composition of claim 43 wherein at least one N-heteroaromatic compound is pyridine.

45. The composition of claim 43 wherein at least one N-heteroaromatic compound is 4-methylpyridine.

46. The composition of claim 43 wherein at least one N-heteroaromatic compound is 2,4,6-collidine.

47. The composition of claim 43 wherein at least one N-heteroaromatic compound is 2-bromopyridine.

48. The composition of claim 43 wherein at least one N-heteroaromatic compound is 4-cyanopyridine.

49. The composition of claim 43 wherein at least one N-heteroaromatic compound is 2-(2'-hydroxyethyl) pyridine.

50. The composition of claim 43 wherein at least one N-heteroaromatic compound is 4-(3'-hydroxypropyl) pyridine.

51. The composition of claim 43 wherein at least one N-heteroaromatic compound is 2-benzylpyridine.

52. The composition of claim 43 wherein at least one N-heteroaromatic compound is 4-benzylpyridine.

53. The composition of claim 43 wherein at least one N-heteroaromatic compound is 4-benzoylpyridine.

54. The composition of claim 43 wherein at least one N-heteroaromatic compound is 4-(3'-phenylpropyl) pyridine.

55. The composition of claim 43 wherein at least one N-heteroaromatic compound is 1-sulfopropyl-4-phenylpropyl pyridinium betaine.

56. The composition of claim 43 wherein at least one N-heteroaromatic compound is 4'-sulfo-4-phenyl propylpyridine.

57. The composition of claim 43 wherein at least one N-heteroaromatic compound is 2-benzalpicoline (2-styrylpyridine 2-stilbazole).

58. The composition of claim 43 wherein at least one N-heteroaromatic compound is 1-sulfopropyl-2-styryl pyridinium betaine.

59. The composition of claim 43 wherein at least one N-heteroaromatic compound is diphenyl-4-pyridyl methane.

60. The composition of claim 43 wherein at least one N-heteroaromatic compound is 4-pyridylethylsulfonic acid.

61. The composition of claim 43 wherein at least one N-heteroaromatic compound is 4,4'-dipyridyl.

62. The composition of claim 43 wherein at least one N-heteroaromatic compound is 1,1'-dimethyl-4,4'-dipyridynium dichloride.

63. The composition of claim 43 wherein at least one N-heteroaromatic compound is 1,3-di-(4,4'pyridyl)-propane.

64. The composition of claim 43 wherein at least one N-heteroaromatic compound is 1,3-di-(4,4'pyridyl-N,N' dipropane-sulfonic acid betaine)-propane.

65. The composition of claim 43 wherein at least one N-heteroaromatic compound is 1,3-(4,4'pyridyl) propane N,N' dioxide.

66. The composition of claim 43 wherein at least one N-heteroaromatic compound is 1,2-di-(4,4'pyridyl)-ethylene.

67. The composition of claim 43 wherein at least one N-heteroaromatic compound is 2,2-dipyridyl.

68. The composition of claim 43 wherein at least one N-heteroaromatic compound is 1,1-ethylene-2,2'-dipyridinium dibromide.

69. The composition of claim 43 wherein at least one N-heteroaromatic compound is 2,2'-pyridil-1,2-di(-2'pyridyl) glyoxal.

70. The composition of claim 43 wherein at least one N-heteroaromatic compound is quinoline.

71. The composition of claim 43 wherein at least one N-heteroaromatic compound is 8-hydroxyquinoline (8-quinolinol).

72. The composition of claim 43 wherein at least one N-heteroaromatic compound is 8-hydroxyquinoline-5-sulfonic acid.

73. The composition of claim 43 wherein at least one N-heteroaromatic compound is 2-hydroxy quinoline(2-quinolinol).

74. The composition of claim 43 wherein at least one N-heteroaromatic compound is 2-chloroquinoline.

75. The composition of claim 43 wherein at least one N-heteroaromatic compound is 2-iodoquinoline.

76. The composition of claim 43 wherein at least one N-heteroaromatic compound is quinaldine.

77. The composition of claim 43 wherein at least one N-heteroaromatic compound is N-propargylquinaldinium bromide.

78. The composition of claim 43 wherein at least one N-heteroaromatic compound is N-sulfopropylquinaldinium betaine.

79. The composition of claim 43 wherein at least one N-heteroaromatic compound is 2-chloromethylquinoline hydrochloride.

80. The composition of claim 43 wherein at least one N-heteroaromatic compound is isoquinoline.

81. The composition of claim 43 wherein at least one N-heteroaromatic compound is

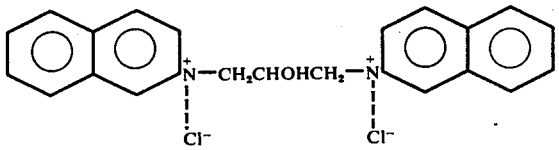

82. The composition of claim 43 wherein at least one N-heteroaromatic compound is 5,6-benzoquinoline.

83. The composition of claim 43 wherein at least one N-heteroaromatic compound is 7,8-benzoquinoline.

84. The composition of claim 43 wherein at least one N-heteroaromatic compound is acridine (2,3-benzoquinoline).

* * * * *